US005235128A

United States Patent [19]

Hardesty et al.

[11] Patent Number: 5,235,128

[45] Date of Patent: Aug. 10, 1993

[54] SEPARABLE MISSILE NOSECAP

[75] Inventors: Dallas M. Hardesty, Kent; Ernest Knaus, Akron, both of Ohio

[73] Assignee: Loral Corporation, New York, N.Y.

[21] Appl. No.: 687,264

[22] Filed: Apr. 18, 1991

[51] Int. Cl.[5] ..... F42B 4/06

[52] U.S. Cl. ..... 102/351; 102/354; 102/489

[58] Field of Search ..... 102/398, 351, 353, 354, 102/393, 489

[56] References Cited

U.S. PATENT DOCUMENTS

| | | | |
|---|---|---|---|
| 3,754,725 | 8/1973 | Kartzmark et al. | 102/378 X |
| 4,455,943 | 6/1984 | Pinson | 102/489 |
| 4,788,914 | 12/1988 | Frater | 102/399 |
| 4,867,393 | 9/1989 | Faupell et al. | 244/3.22 |
| 5,206,455 | 4/1993 | Williams et al. | 102/201 |

*Primary Examiner*—Peter A. Nelson
*Attorney, Agent, or Firm*—L. A. Germain

[57] ABSTRACT

This invention provides provides a separable nosecap for the forward end of a homing torpedo, the nosecap and torpedo comprising a missile that is launched into the atmosphere for a ballistic trajectory to a distant underwater target. The nosecap comprises a nosecap shell having a volume of rigid cushioning foam material within its interior space defining a cavity into which is mounted a pneumatic apparatus including a flexible inflatable sleeve for forcefully disengaging the nosecap from the torpedo after the missile has entered the water environment. The inflatable sleeve engages the forward end of the torpedo and, upon inflation and axial extension, the sleeve disengages the nosecap from its mounting to the torpedo such that a homing mechanism of the torpedo may guide it to the intended target.

21 Claims, 3 Drawing Sheets

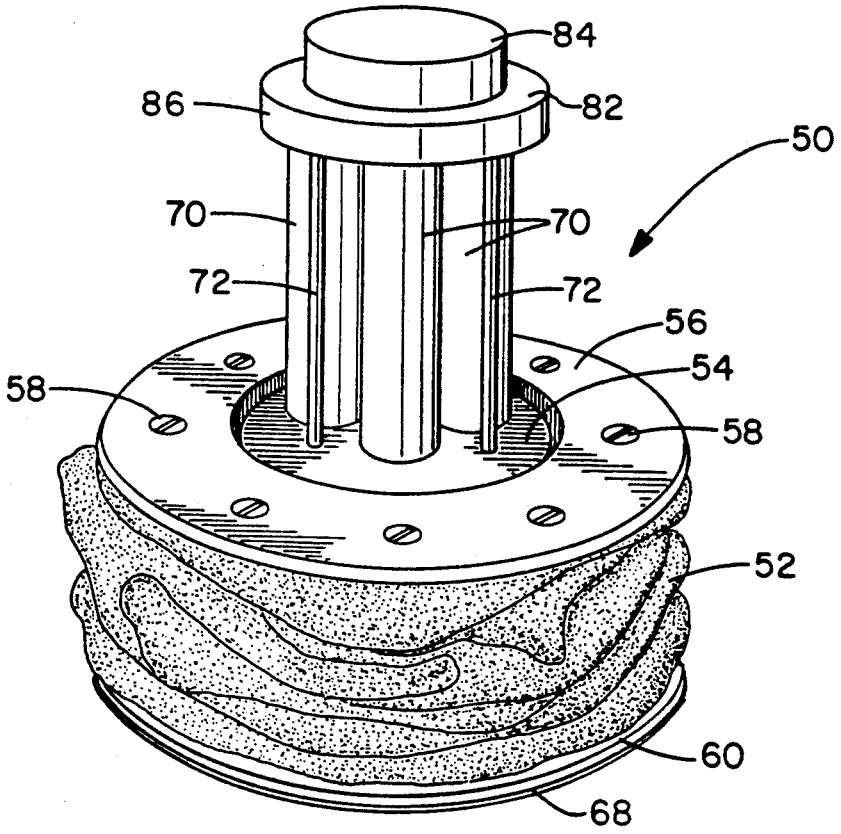
FIG.-4
FIG.-5
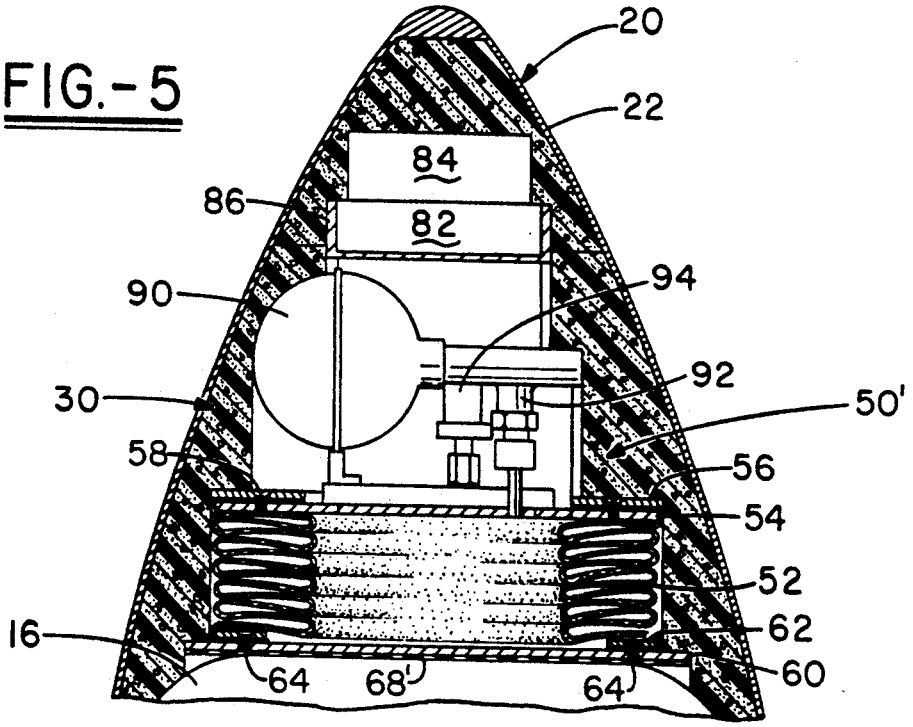

SEPARABLE MISSILE NOSECAP

FIELD OF THE INVENTION

This invention generally pertains to missiles of the type which include a homing torpedo as a primary element of the missile configuration. The missile is conventionally fired from a launching canister and it is airborne for a portion of its mission to an underwater target at some distance from the launch site whereupon it enters the water environment. The torpedo then searches out and destroys the target.

More particularly, the present invention pertains to a unique configuration for a missile nosecap which presents an aerodynamic forward end to the missile for airborne flight and a protective shield for water entry impact but which may also be effectively separated from the homing torpedo such that the torpedo may complete the mission to, and destroy, the intended target.

Specifically, the present invention provides a separable missile nosecap which is removed pneumatically from the homing torpedo after the missile enters the water environment.

BACKGROUND OF THE INVENTION

It is an important consideration in this type of missile application that the homing mechanism which is located at the forward end of the torpedo be protected from damage throughout the mission environment, i.e., when fired from the launching canister, during airborne flight to the target area, and upon water impact and entry. Damage to the torpedo homing mechanism during any portion of the mission will obviously result in defeat of the torpedo performance and, thus also, a defeat of the entire mission.

U.S. Pat. No. 4,788,914 issued Dec. 6, 1988 to James T. Frater describes a missile nosepiece comprised of a frangible base member and a separable nosecap, the base comprised of multiple segments of rigid foam defining an axial bore and a volume of soft cellular foam within the bore to protect the forward end of the torpedo which houses the torpedo homing mechanism. The nosecap is mounted to the base member is such a manner that it may be separated from the base prior to water entry such as to expose the central bore into the frangible base member. Upon water impact, the force of the water entering the exposed central bore effects fracturing of the base and it is separated from the forward end of the torpedo.

The above-described missile nosepiece of the prior art depends for its successful operation upon a separation of the nosecap from the base prior to water impact so as to expose the central bore into the frangible base. If, for some reason the nosecap does not fall away from the base before water impact, then fracturing of the base member will not be effected and the nosepiece will remain on the forward end of the homing torpedo. Obviously, this will impede the operation of the homing mechanism. It should also be clear that the nosecap must be separated from the base member at an altitude and in time before water impact so that a water force of sufficient magnitude enters the base central bore and/or is generated within the central bore to effect fracturing of the base member. Thus, even if the nosecap is removed from the frangible base member, sufficient water impact forces must be generated to fracture the base so that it may be separated from the forward end of the homing torpedo.

SUMMARY OF THE INVENTION

This invention intends to meet the need in this art for a variably-controlled and separable nosecap for the forward end of a homing torpedo type missile that is launched into the atmosphere for a ballistic trajectory to an underwater target, the nosecap comprising a nosecap shell including a volume of rigid foam cushioning material within its interior defining a central bore into which a pneumatic means is mounted, the pneumatic means comprising: an axially inflatable sleeve member; means at the top end of the sleeve member to effect a rapid inflation of the sleeve; means at the bottom end of the sleeve member to engage and protect the forward end of the homing torpedo; and, means for generating an electrical signal for application to the means for effecting sleeve member inflation such that upon a rapid inflation of the sleeve member, the nosecap is forcefully disengaged and separated from the forward end of the torpedo after the missile has entered the water environment.

BRIEF DESCRIPTION OF THE DRAWINGS

For a complete understanding of the invention, reference should be made to the following detailed description and to the accompanying drawings, in the several figures in which like-reference numerals indicate like elements and wherein:

FIG. 4 is a perspective view of an inflatable flexible sleeve and its associated inflation means, the sleeve being shown in the collapsed condition for stowage within the nosecap shell; and FIG. 5 is an elevational view, partially broken away and in cross-section, of a nosecap similar to FIG. 1 but illustrating a second embodiment of inflation means for the flexible inflatable sleeve member.

DETAILED DESCRIPTION OF THE INVENTION

Figure 1:
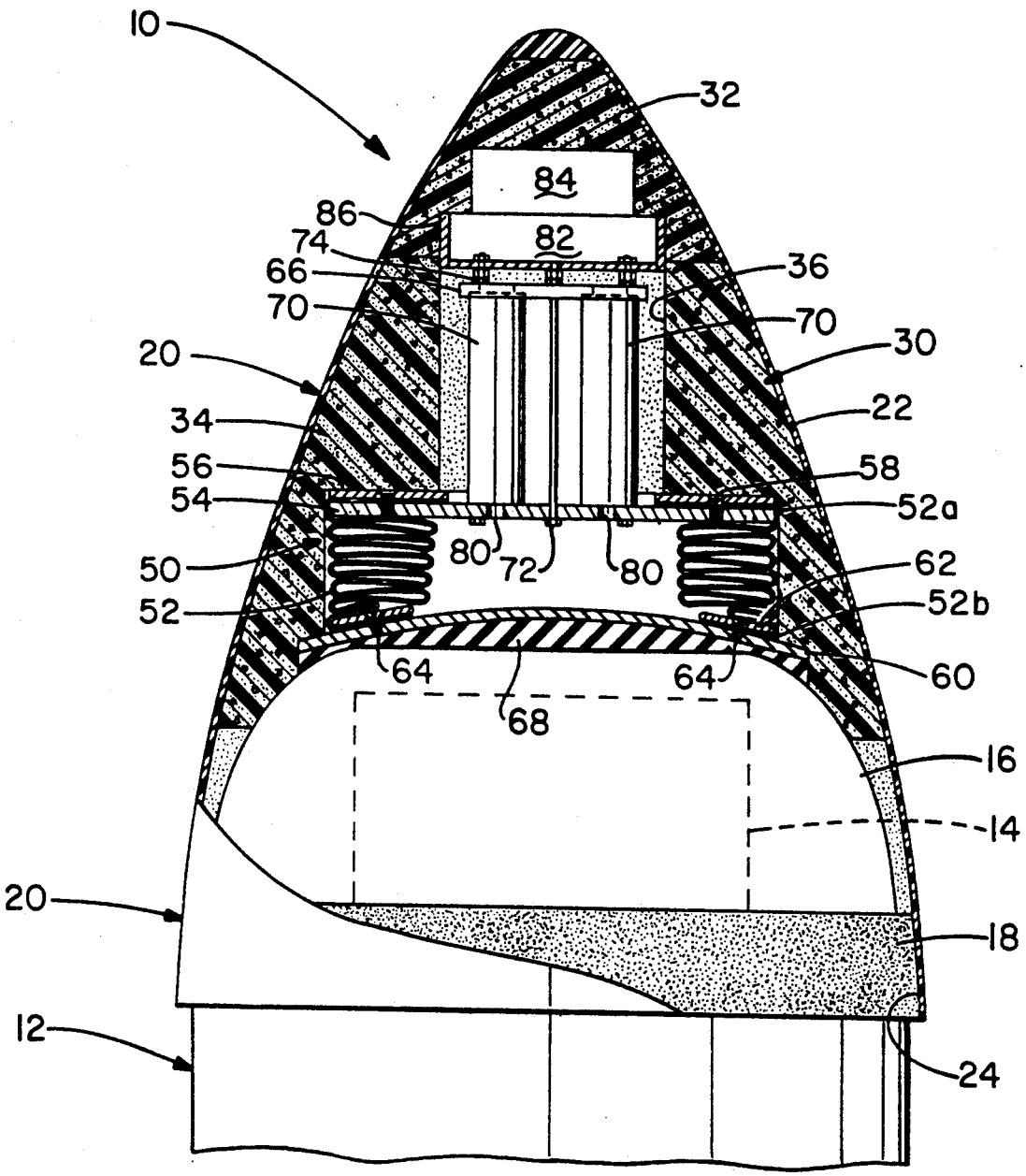
FIG. 1 is an elevational view, partially broken away and in cross-section, of the forward end of a missile showing the various elements of an attached and separable nosecap which forms the present inventive concept.

Referring to the drawings, FIG. 1 is an elevational view of the forward end of a missile generally indicated by reference numeral 10, the figure being a cross-sectional view of the forward end to expose the various elements which form the present inventive concept. The missile 10 is in a primary configuration of a torpedo generally indicated at numeral 12 and it is characterized by a homing mechanism 14 positioned at, and mounted to, the forward end. The homing mechanism 14 will conventionally comprise an acoustic homing device known in the art, however, it may as well comprise any other type device which may be applied to the water environment for detecting particular types of underwater targets. In any event, the homing mechanism 14 is mounted within the confines of a non-metallic sonar type transducer housing 16 in the conventional manner of such type of devices. The rearward end of the torpedo 12 (not shown in the drawing) includes a propulsion means and any of various other specifics of the torpedo which are not shown are not considered important to the scope of the present invention, suffice to say, that the torpedo 12 is of a known type which may be launched for airborne flight to a distant underwater target whereupon entering the water environment, the homing mechanism 14 searches out the target such that it may be destroyed by the torpedo.

A nosecap, generally indicated by reference numeral 20, is mounted to the forward end of the torpedo 12 to provide an aerodynamic forward shape to the missile 10 for airborne flight. Generally and hereinbefore alluded to, missiles of this type are explosively fired out of an enclosed launching canister, the cover of the canister being broken away by the forward end of the missile. The missile then follows a ballistic flight path to a target area. Upon reaching the termination of its airborne flight path, the missile nosecap must be removed such that the homing mechanism of the torpedo 12 may function according to its intended purpose, i.e., to search out an underwater target. In this environment, the missile 10 must include a nosecap 20 which is capable of accepting the compressive load forces encountered upon breaking through the launching canister cover, to provide protection during flight, and to accept the forces generated at water entry impact.

The present invention provides a missile nosecap 20 which is uniquely configured to accept the beforementioned compressive forces while also being separable from the homing torpedo 12 after the missile enters the water environment. A first embodiment of the invention is illustrated in FIG. 1 and it comprises a nosecap 20 having an outer shell 22. The shell 22 has a rearwardly-directed open end 24 which is mated to the forward end of the torpedo 12 and this may be accomplished by various known techniques. For example and as illustrated in FIG. 1, an annular seal ring indicated at 18 may be used to effect an interference fit between the nosecap shell 22 and the outer surface of the torpedo 12. The seal ring 18 may be made from various type materials and in various configurations such that the nosecap 20 may be easily moved onto the end of the torpedo 12 but it may not be easily moved in the opposite direction, i.e., removed from the torpedo 12. A particular seal ring 18 may be comprised of an elastomeric or suitable plastic material and these type of seal rings are known and used in various of the arts. The present invention, therefore, is not considered limited to the particular manner or method of mounting of the nosecap 20 to the forward end of the torpedo 12.

The nosecap 20 comprises, but is not limited to, a fiberreinforced composite material which is molded to a 1.25 Von Karman ogive shell shape. Of course, other known ogive shapes may be applied for this application and other known materials may be used which will meet the needs of the invention. For example, a chopped fiberglass-impregnated resin composite provides a suitable and sufficiently strong nosecap shell 22 which is capable of withstanding the compressive axial forces encountered by the missile 10 in its particular operational environment.

Alternatively, and as hereinbefore suggested, the nosecap shell 22 may be comprised of a metallic material such as, for example, a machined aluminum. Obviously, weight will be a primary consideration and, therefore, various known other type of materials may be applied for the nosecap shell and these are all considered within the scope of the present invention.

The nosecap shell 22 has its interior partially filled with a volume of a cushioning foam material which preferably comprises a rigid type foam indicated generally at reference numeral 30. The foam material 30 may be cast-in-place into the interior of the shell 22 and to its particular contour. Alternatively, the foam material 30 may be pre-cast for a later insertion into the shell 22. The manner of forming of the foam material 30 may be accomplished by various wellknown techniques and it is not an important consideration within the context of the present invention. Further, the foam material 30 may be cast in a single step or in multiple steps and, again, the exact manner of accomplishing this is not important to the present inventive concept. In any event, FIG. 1 of the drawings shows a volume of foam material 32 at the interior tip end of the nosecap shell 22 and this may comprise a rigid type foam material. A second volume of foam material is indicated at reference numeral 34 and this may comprise a softer more compressive type rigid foam so as to provide cushioning for the homing mechanism 14 at the forward end of the torpedo 12.

The foam material 30 defines an axial bore or cavity generally indicated at 36 which penetrates a substantial length, but not completely, into the interior of the nosecap shell 22. For reasons to become clear hereinafter, the cavity 36 may be formed into a stepped bore of differing diameters to facilitate receiving and mounting of the various elements forming the present invention. Alternatively, the foam material 30 may be cast around the elements to be housed within the cavity 36 and thus, the cavity 36 will be formed to the contours of the different elements.

Continuing with reference to FIG. 1, a first embodiment of the invention comprises a pneumatic means generally indicated at reference numeral 50. The pneumatic means 50 includes a flexible and axially inflatable sleeve member 52 which is illustrated in the drawing as it may be mounted in a collapsed non-inflated condition within the nosecap bore 36. More specifically, the flexible sleeve member 52 is mounted at its top or upper end 52a by way of a plate 54 and a ring 56 which encapsulate the end of the sleeve between them. The plate 54 and ring 56 are maintained in a clamping relationship by a plurality of fastening means 58 which may comprise various type of screws and/or bolts. At the bottom or lower end 52b of the sleeve member 52 a second set of a plate 60 and a ring 62 are used to close off the bottom end of the sleeve and these are maintained in clamped relationship by a plurality of fastening means 64.

The top plate 54 has at least one gas generator unit 70 positioned between it and another plate 66 and the plates 54,66 form a clamping relationship for the unit 70 by a plurality of long bolts 72 capped with nuts 74. The gas generator unit 70 is of a known type and it conventionally will contain a chemical mixture which, when ignited, generates a large volume of gas in a very short period of time. Gas generator units 70 may be obtained in various sizes and gas generating capacities and the particular one and/or type of unit used will depend upon the specific application. For example and as illustrated in the drawings, the applicants have mounted four gas generator units 70 in a balanced arrangement between the two plates 54,66 and each of these is positioned in axial relationship to a bore 80 passing through the plate 54. It should be clear from the showing in FIG. 1, that the size and number of gas generator units 70 will be dictated by the volume space available within the bore space 36 of the rigid foam material 30 and/or by the overall interior volume space available within the nosecap shell 22. Further, the specifics of the gas generator units 70 will also be dictated by the volume of gas required to inflate the pneumatic sleeve member 52. In view of this, the present invention is not considered limited by the size, the number, and/or the type of gas generator units 70 which may be applied to the application.

The ignition that is required to operate the gas generator units 70 is accomplished by circuitry which may be of any conventional design and mounted within the bore 36 at reference numeral 82 and by a power source indicated at 84. Initiation of the gas generator unit ignition may be accomplished by, for example, a pressure sensitive switch (not specifically shown) which forms a part of the circuitry in a conventional manner. In addition, each of the gas generator units 70 has an electro-initiated pyrotechnic squib associated with its configuration and the circuitry 82 passes an ignition current to the squibs in response to the pressure sensitive switch. This is, of course, a well-known technique and well within the knowlege and abilities of persons working in this art to accomplish.

In operation and after the missile 10 has entered the water environment, the pressure sensitive switch activates the circuitry 82 which effects firing of the pyrotechnic squibs associated with each gas generator if more than one is used in the system. Ignition of the gas generator units 70 generates a large volume of gas which passes through the mounting plate bores 80 and into the top end of the sleeve member 52 which inflates in the axial direction. It should be obvious that the sleeve member 52 will effect a forceful disengagement of the nosecap 20 from off of the forward end of the torpedo 12 such that the torpedo may be directed to the target by the homing mechanism 14.

Because the inflation gases generated by the gas generator units 70 may be associated with very high temperatures in excess of 1500° F., the homing mechanism 14 must be protected from these high temperatures. This may be accomplished in various ways and a particular one is illustrated in FIG. 1. As evident from the drawing, the bottom sleeve member retaining plate 60 may be formed to a concave configuration such that it is displaced axially away from the surface of the homing mechanism transducer housing 16. In addition, a known type of silicone rubber insulation 68 may be adhered to the bottom surface of the concave plate 60 to provide a cushion and add further insulative properties between the plate 60 and the housing 16. In this way, the homing mechanism 14 may be protected from any adverse forces and/or harmful heat generated by the pneumatic means 50.

Figure 2:
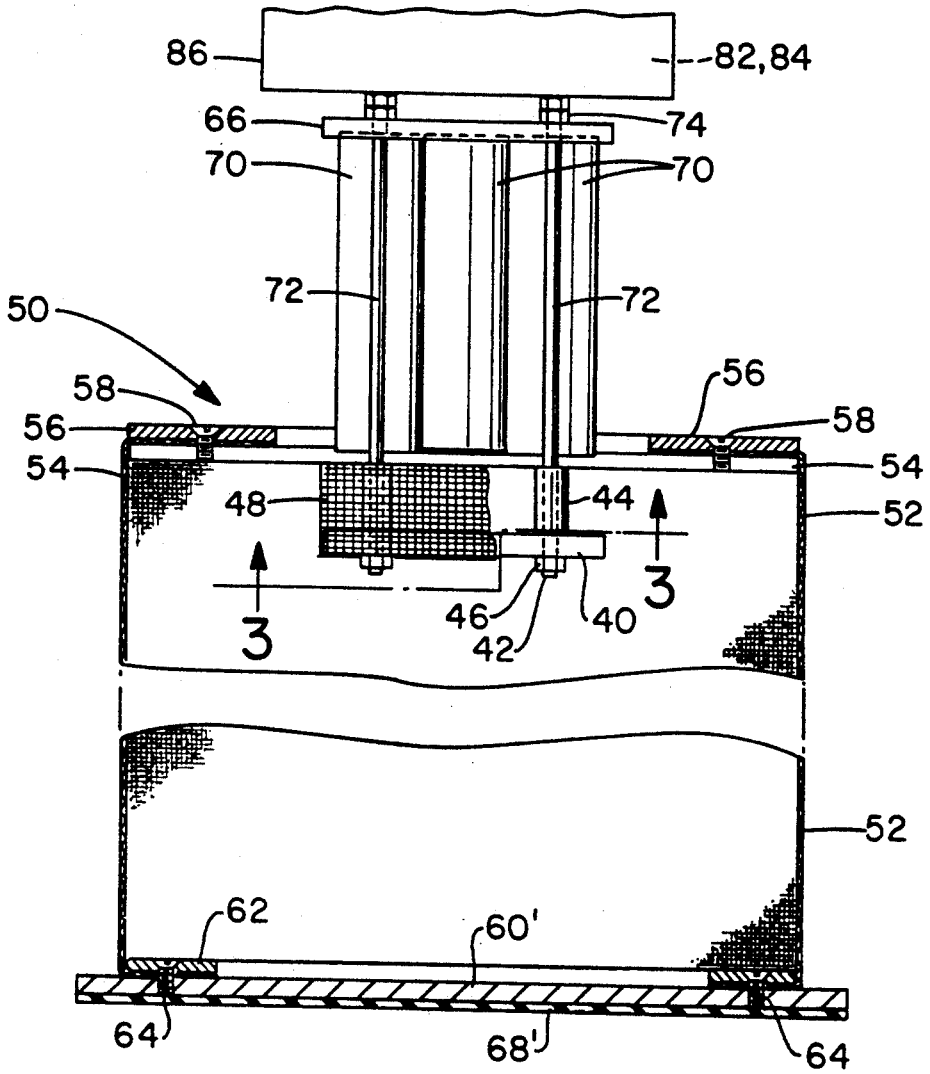
FIG. 2 is an elevational view, partially broken away and in cross-section, of a pneumatic means as may be applied for removing the missile nosecap from the forward end of a homing torpedo which forms a primary element of the missile configuration.
Figure 3:
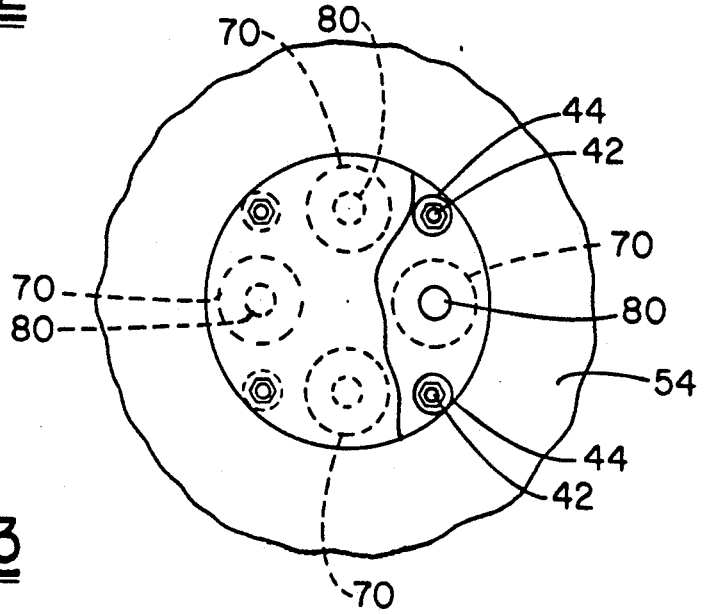
FIG. 3 is a plan view as may be taken on line 3—3 of FIG. 2 illustrating the exit end of the pneumatic means for inflating a flexible sleeve member.

Referring now to FIGS. 2 and 3 of the drawings, an alternative method of heat isolation is illustrated which comprises a heat shield plate 40 mounted at the top end of the sleeve member 52 and in spaced relationship to the mounting plate 54. The heat shield plate 40 is mounted via a plurality of bolts 42 each of which carries a spacer means 44 and is secured by a nut 46. The spacers 44 maintain a set stand-off distance between the mounting plate 54 and the heat shield plate 40 so that any hot inflation gases passing out of the bores 80 in the plate 54 and into the interior of the sleeve are first deflected by the heat shield plate 40 and cooled sufficiently before any damaging high temperatures may be sensed at the torpedo homing mechanism 14. In addition, a screen member 48 may be mounted about the peripheral extent of the heat shield plate 40, between it and the mounting plate 54. The purpose of the screen member 48 is to keep the flexible sleeve member 52 from entering the space between the two plates when the sleeve is in the collapsed stowed condition. The high heat of the inflation gases may also be detrimental to the materials comprising the inflatable sleeve member and, so as to provide a foolproof inflation of the sleeve, the protective screen member 48 should be installed.

While this type of heat shielding within the interior of the sleeve member may require one to protect the inflation integrity of the sleeve member 52, it may not require that the lower mounting plate 60 be formed to a concave configuration as illustrated in FIG. 1. Accordingly, a lower sleeve mounting plate may comprise a flat plate 60' having a layer of silicone rubber insulation 68' adhered to its underside surface adjacent to the homing mechanism housing 16 as shown in FIG. 2.

FIG. 4 of the drawings shows the pneumatic means 50 as it may be assembled prior to being mounted within the nosecap shell 22. As illustrated, the inflatable sleeve member 52 is in a collapsed non-inflated condition between the two mounting plates 54 and 60 and the gas generators 70 are fixedly clamped between the sleeve mounting plate 54 and the plate 66 by long bolts 72. The circuit and power supply packages 82 and 84 respectively, may also comprise elements of the pre-assembly, and this, by way of a mounting means 86 which is also shown in FIGS. 1 and 2 of the drawings. Clearly, the bolts 72 may be utilized for affixing the mounting means 86 to the pre-assembly as these may be made sufficiently long for this purpose. In this respect, it should be noted that the circuit package 82 and the power supply package 84 may as well be mounted elsewhere within the confines of the nosecap shell 22 and also that these elements may be in various and numerous configurations. Also, the interior rigid foam material 30 may be formed to any configuration to accommodate the locations of these elements and/or their manner of mounting within the shell 22. Accordingly, this invention is not considered limited in the manner of mounting and/or the location of these particular elements within the nosecap 20.

In the assembly of the nosecap 20 when the foam material 30 is a cast-in-place foam done within the interior of the nosecap shell 22, the pre-assemblies of the elements forming the pneumatic means 50 as shown in FIGS. 1 and 4 may be inserted into the bore 36 of the foam material 30 and the nosecap 20 and its pneumatic means 50 may be mounted to and fixedly attached to the forward end of the homing torpedo 12 via the annular sealing ring 18.

Alternatively, if the foam material 30 comprises a precast material done outside of the nosecap shell 22, then the pre-assemblies comprising the pneumatic means 50 may be inserted into the bore 36 of the foam material and maintained there by the use of various known fastening means. The entire assembly of foam material 30 and pneumatic means 50 may then be inserted into the nosecap shell 22 and secured there by an appropriate adhesive system applied to the outer surface of the foam material 30. Additionally and as hereinbefore suggested, the foam material may be cast about the pre-assembled pneumatic means 50 to an outer contour of the interior of the nosecap shell. Obviously, various techniques and methods of assembling the elements which comprise the nosecap 20 are possible and within the knowledge of the particular art.

It will, of course, be recognized by those persons skilled in this art, that the pneumatic means 50 may be comprised of elements which are not "hot-gas" inflation systems, i.e., the gas generators 70 are not the only means useful for almost instantaneous inflation of the inflatable sleeve member 52. It will be appreciated that a "cold-gas" system may be employed and such system is illustrated in FIG. 5 of the drawings. The "cold-gas" system is generally indicated by reference numeral 50' and such system may comprise a source of compressed gas 90 which may be a tank of any convenient configuration to facilitate mounting within the confines of the nosecap shell 22. The source of compressed gas 90 may, of course, be mounted to the upper mounting plate 54 in the conventional manner and it will include a needle valve mechanism 92 which may be rendered operational by a pyrotechnic squib type initiator 94 in the well-known and understood manner of such type devices. Obviously, the squib 94 may be fired by an appropriate current from the power supply 84 and this current may be governed by the circuit 82 in response to a pressure sensitive, or other type of switch as hereinbefore described with respect to the "hot-gas" system 50 of FIGS. 1 and 4.

With respect to the ignition of either of the gas generator system 50 or the compressed gas system 50', it will be apparent that both systems may be initiated by a means other than a pressure sensitive switch. Because the missile 10 enters the water environment and it tends to sink, a pressure sensitive switch seems to be the logical means for initiating pneumatic inflation of the sleeve member 52 for forceful disengagement of the nosecap 20. However, a conventional switch may be utilized in the circuit 82 and it may be controlled by an electronic clock which is started at lift-off of the missile from its launching canister. Furthermore, the switch may comprise a known type of impact initiated switch which is rendered operational when the missile 10 impacts the water for water entry. In view of these alternatives, the invention is intended to cover the various type of pneumatic means initiation and ignition for pneumatic sleeve inflation.

Finally, the flexible inflatable sleeve member 52 is made so as to move primarily in the axial direction upon being inflated. This is so that the maximum force that is available from a particular capacity inflation means may be applied towards the torpedo 12 and total disengagement of the nosecap 20 is effected. The sleeve member 52 may be comprised of a densely woven fabric that is coated with a suitable elastomeric material on its inside facing surface so as to insure an airtight sleeve. The fabric may be comprised of fibers and/or yarns taken from the group including aramid, nylon, and polyester and other similar synthetic materials and/or the combination of such materials. The fabric may be made and/or oriented in a manner to limit any radial expansion of the sleeve member upon its being inflated. This is, of course, a well-known and understood technique in the art of engineered fabrics as this has been applied to the manufacture of air springs and similar type devices. Further, and in the application of the sleeve member 52 to a "hot-gas" inflation system 50, the interior surface of the sleeve may be coated with a suitable heat resistant material such as, for example, a silicone rubber.

It will, of course, be apparent that this invention is applied to apparatus that may only be used for a "one-shot" application. In other words, once the missile 10 is launched towards an intended target it is only necessary and important that the pneumatic means 50 or 50' work flawlessly for this one time and the nosecap 20 is removed from the torpedo 12. After being disengaged from the forward end of the torpedo the nosecap 20 and the elements which comprise it are lost to the environment. Therefore, it will be apparent to those skilled in the art that various changes and/or modifications may be made for the sake of economy without sacrificing dependable and flawless operation and without departing from the spirit or scope of the inventive concept.

What is claimed is:

1. A nosecap for the forward end of a homing torpedo forming a primary element of a missile that is launched into the atmosphere for a ballistic trajectory to a distant underwater target, the nosecap being separable from the torpedo after water entry and comprising in combination:

an ogive-shaped nosecap shell having an open rearwardly directed end adapted for mounting engagement with the forward end of the torpedo such as to be maintained on the torpedo at launch from a launching canister, during airborne flight to the target area, and at water entry impact;

a substantially rigid cushioning foam material secured within the interior of the nosecap shell, the foam defining a cavity which penetrates a particular length into the nosecap shell;

pneumatic means mounted within the cavity formed by the foam and comprising:

a flexible axially inflatable sleeve;

means at a bottom end of the sleeve for engaging the forward end of the torpedo;

means at a top end of the sleeve for effecting a rapid inflation of the sleeve; and means for generating an electrical signal for application to the means for effecting sleeve inflation such as to initiate rapid inflation of the sleeve and the nosecap is forcefully disengaged and and separated from the forward end of the torpedo.

2. The nosecap as set forth in claim 1 wherein the means at the top end of the inflatable sleeve for effecting rapid inflation comprises at least one gas generator having an ignition means responsive to the means for generating an electrical signal.

3. The nosecap as set forth in claim 1 wherein the means at the top end of the inflatable sleeve for effecting rapid inflation comprises a source of compressed gas having an ignition means responsive to the means for generating an electrical signal.

4. The nosecap as set forth in claim 1 wherein the means for generating an electrical signal comprises a power supply, a switch means, and circuit means for transmitting a current signal to the means for effecting sleeve inflation in response to an activation of the switch means.

5. The nosecap as set forth in claim 4 wherein the switch means comprises a pressure activated switch.

6. The nosecap as set forth in claim 4 wherein the switch means comprises an impact activated switch.

7. The nosecap as set forth in claim 4 wherein the circuit means includes a clock which effects an activation of the switch means after the missile enters the water.

8. The nosecap as set forth in claim 1 wherein the nosecap shell comprises a fiber-reinforced composite material and the rigid cushioning foam is cast-in-place within the interior of the shell.

9. The nosecap as set forth in claim 1 wherein the nosecap shell comprises a fiber-reinforced composite material and the rigid cushioning foam is a pre-cast that forms an assembly with the pneumatic means and the assembly is adhesively secured within the interior of the nosecap shell.

10. The nosecap as set forth in claim 1 wherein the means at the bottom end of the sleeve for engaging the forward end of the torpedo comprises a metal plate and a thickness of silicone rubber to distribute inflation load forces and to dissipate any heat which may be generated upon the inflation of the sleeve.

11. The nosecap as set forth in claim 10 wherein the metal plate is concave shaped.

12. The nosecap as set forth in claim 1 wherein the nosecap shell is comprised of a metal.

13. The nosecap as set forth in claim 12 wherein the nosecap shell is comprised of a machined aluminum.

14. The nosecap as set forth in claim 1 wherein the inflatable sleeve comprises a densely woven synthetic fiber fabric having an elastomeric coating on the inside surface that insures the airtight integrity of the sleeve.

15. The nosecap as set forth in claim 2 wherein the inflatable sleeve has a heat resistant coating on its inside surface.

16. The nosecap as set forth in claim 15 wherein a heat shield plate is mounted at the top end of the sleeve in spaced relationship to the at least one gas generator to dissipate any heat associated with the inflation gas.

17. The nosecap as set forth in claim 16 wherein a screen is mounted in association with the heat shield plate to prevent the sleeve from entering the space between the heat shield plate and the at least one gas generator when the sleeve is in a non-inflated condition.

18. Apparatus for use in combination with a missile comprising an aerodynamic nosecap affixed to the forward end of a torpedo having a homing mechanism within its forward end, the missile adapted to be launched into the atmosphere for a ballistic trajectory to a distant underwater target to seek out and destroy the target, the apparatus comprising:

a flexible axially inflatable sleeve;

means affixed at a bottom end of the sleeve to seal the sleeve and provide a cushioned and abutting relationship with the forward end of the torpedo;

means affixed at a top end of the sleeve to seal the sleeve and provide a source of gas for inflating the sleeve;

means for generating an electrical signal for application to the means providing a source of gas, said means including a power supply, a switch means, and circuit means for transmitting the signal to the source of gas in response to an activation of the switch means;

said apparatus mounted within the missile nosecap such that activation of the switch means effects an ignition of the source of gas and the inflating sleeve forces a disengagement of the nosecap from the torpedo such that the torpedo may continue to the target under the guidance of the homing mechanism.

19. The apparatus as set forth in claim 18 wherein the means providing a source of gas comprises at least one gas generator ignited by an electrical signal to a pyrotechnic squib.

20. The apparatus as set forth in claim 18 wherein the means providing a source of gas comprises a tank of compressed gas having a valve initiated by a pyrotechmic squib that is responsive to an electrical signal.

21. The apparatus as set forth in claim 18 wherein the switch means is activated upon missile impact entry into the water environment.

* * * * *